US010313797B2

(12) United States Patent
Yoo

(10) Patent No.: US 10,313,797 B2
(45) Date of Patent: Jun. 4, 2019

(54) MICROPHONE, MANUFACTURING METHOD AND CONTROL METHOD THEREOF

(71) Applicant: Hyundai Motor Company, Seoul (KR)

(72) Inventor: Ilseon Yoo, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 70 days.

(21) Appl. No.: 15/363,701

(22) Filed: Nov. 29, 2016

(65) Prior Publication Data

US 2018/0077498 A1 Mar. 15, 2018

(30) Foreign Application Priority Data

Sep. 9, 2016 (KR) ..... 10-2016-0116718

(51) Int. Cl.

| | |
|---|---|
| ***H04R 25/00*** | (2006.01) |
| ***H04R 19/02*** | (2006.01) |
| ***H04R 7/06*** | (2006.01) |
| ***H04R 7/18*** | (2006.01) |
| ***H04R 19/00*** | (2006.01) |
| ***H04R 31/00*** | (2006.01) |
| ***H04R 19/04*** | (2006.01) |
| ***H04R 29/00*** | (2006.01) |

(52) U.S. Cl.

CPC ..... *H04R 19/02* (2013.01); *H04R 7/06* (2013.01); *H04R 7/18* (2013.01); *H04R 19/005* (2013.01); *H04R 19/04* (2013.01); *H04R 29/004* (2013.01); *H04R 31/00* (2013.01); *H04R 31/003* (2013.01); *H04R 2201/003* (2013.01)

(58) Field of Classification Search

CPC . H04R 19/02; H04R 7/06; H04R 7/18; H04R 19/005

USPC ..... 381/174; 257/416; 73/504.12

See application file for complete search history.

(56) References Cited

U.S. PATENT DOCUMENTS

| | | | | |
|---|---|---|---|---|
| 8,174,085 | B2 * | 5/2012 | Nakatani | G01L 9/0042 257/417 |
| 8,541,852 | B2 * | 9/2013 | Kasai | H04R 19/005 257/415 |
| 2010/0065930 | A1 * | 3/2010 | Nakatani | B81C 1/00476 257/415 |

(Continued)

FOREIGN PATENT DOCUMENTS

| | | | |
|---|---|---|---|
| JP | 2009-089100 | A | 4/2009 |
| KR | 10-0756532 | B1 | 9/2007 |

(Continued)

*Primary Examiner* — Phylesha Dabney

(74) *Attorney, Agent, or Firm* — Mintz Levin Cohn Ferris Glovsky and Popeo, P.C.; Peter F. Corless

(57) ABSTRACT

A microphone, a manufacturing method and a control method of the microphone are provided. The microphone includes an insulating layer bonded to a surface of a substrate in which a sound inlet is formed and includes a plurality of sound apertures. A diaphragm is formed at a position that corresponds to the sound inlet of the substrate on an upper surface of the insulating layer. A displacement adjusting layer is disposed in a circumference of the diaphragm on the upper surface of the insulating layer and is configured to adjust hardness of the diaphragm based on an input sound. A fixing layer is disposed on the diaphragm and the displacement adjusting layer while spaced apart from the diaphragm and the displacement adjusting layer.

8 Claims, 9 Drawing Sheets

(56) References Cited

U.S. PATENT DOCUMENTS

| | | | | |
|---|---|---|---|---|
| 2010/0096714 | A1* | 4/2010 | Nakatani | G01L 9/0042 257/419 |
| 2015/0264462 | A1* | 9/2015 | Okugawa | H04R 19/005 381/174 |
| 2018/0077498 | A1* | 3/2018 | Yoo | H04R 7/06 |

FOREIGN PATENT DOCUMENTS

| | | | |
|---|---|---|---|
| KR | 10-0931575 | B1 | 12/2009 |
| KR | 2013-0091773 | | 8/2013 |
| KR | 10-2015-0030691 | A | 3/2015 |
| KR | 10-1545271 | B1 | 8/2015 |
| KR | 10-1550636 | B1 | 9/2015 |

* cited by examiner

MICROPHONE, MANUFACTURING METHOD AND CONTROL METHOD THEREOF

CROSS-REFERENCE TO RELATED APPLICATION

This application claims priority to and the benefit of Korean Patent Application No. 10-2016-0116718 filed in the Korean Intellectual Property Office on Sep. 9, 2016, the entire contents of which are incorporated herein by reference.

BACKGROUND

(a) Field of the Disclosure

The present disclosure relates to a microphone and more particularly, to a method of manufacturing the microphone and a control method thereof.

(b) Description of the Related Art

Generally, a microphone is a device that converts a voice into an electric signal and is applicable to mobile communication devices that include a terminal and various communication devices (e.g., an earphone or a hearing aid). Recently, the size of the microphone has been reduced and a micro electro mechanical system (MEMS) microphone using the MEMS technology has been developed. The MEMS microphone is manufactured using a semiconductor process and has improved resistance to moisture and thermal exposure than an electret condenser microphone (ECM) in the related art. For example, the microphone may be advantageously reduced in size and integrated with a signal processing circuit. The MEMS microphone has a structure with an acoustic overload point (AOP), sensitivity, and a signal to noise ratio (SNR) among the required specifications.

Accordingly, in a case of high sensitivity, the MEMS microphone according to the related art has a reduced AOP that limits detection of a loud sound and in a case of low sensitivity, the MEMS microphone has a high AOP. In other words, the MEMS microphone detects a loud sound, but has poor performance in detection of a low sound. Accordingly, it is necessary to research and develop the MEMS microphone having a wide acoustic pressure measurement range.

The above information disclosed in this section is merely for enhancement of understanding of the background of the disclosure and therefore it may contain information that does not form the prior art that is already known in this country to a person of ordinary skill in the art.

SUMMARY

The present disclosure provides a microphone that improves an acoustic pressure measurement range and a method of manufacturing the microphone and a control method thereof.

An exemplary embodiment of the present disclosure provides a microphone that may include an insulating layer bonded to a surface of a substrate, in which a sound inlet is formed and having a plurality of sound apertures; a diaphragm formed at a position that corresponds to the sound inlet of the substrate on an upper surface of the insulating layer; a displacement adjusting layer disposed in a circumference of the diaphragm on the upper surface of the insulating layer and configured to adjust a hardness of the diaphragm based on an input sound and a fixing layer disposed on the diaphragm and the displacement adjusting layer while being spaced apart from the diaphragm and the displacement adjusting layer.

The displacement adjusting layer may include a first adjusting layer formed adjacent to a circumference of the diaphragm, a second adjusting layer formed along a circumference of the first adjusting layer spaced apart from the first adjusting layer and a first pad coupled to the first adjusting layer and a second pad coupled to the second adjusting layer.

A plurality of displacement adjusting units may be formed between the first adjusting layer and the second adjusting layer. In the displacement adjusting unit, a plurality of first protruding steps extending from the first adjusting layer to an external side may be alternately disposed with a plurality of second protruding steps extending from the second adjusting layer to an internal side. The displacement adjusting units may be formed at portions that correspond to the sound apertures of the insulating layer.

The fixing layer may be fixed by a sacrificial layer formed along a border of the upper surface of the insulating layer. The fixing layer may include a plurality of apertures. According to the exemplary embodiments of the present disclosure, an acceptable acoustic pressure measurement range may be improved by adjusting hardness of the diaphragm by applying a voltage to the displacement adjusting layer formed adjacent to the diaphragm based on an input acoustic signal.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

Figure 1:
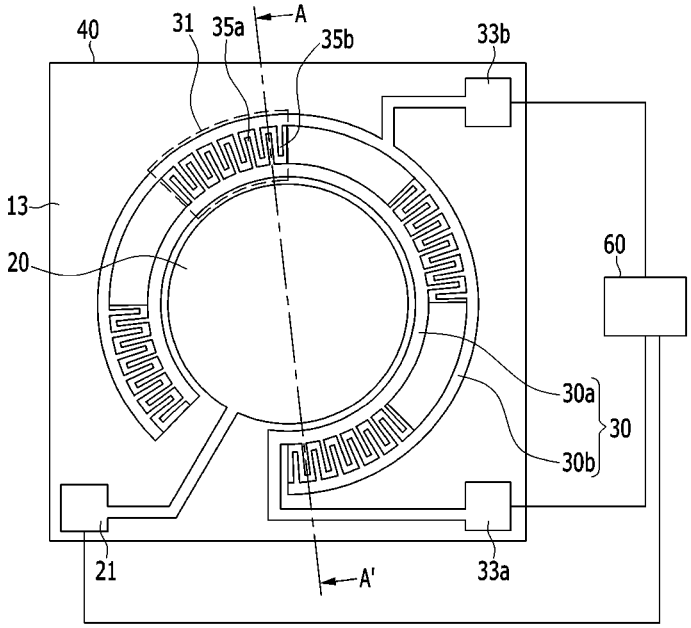
FIG. 1 is an exemplary top plan view of a microphone according to an exemplary embodiment of the present disclosure.

Hereinafter, an exemplary embodiment of the present disclosure will be described in detail with reference to the accompanying drawings. However, the accompanying drawings and detailed descriptions are related to one exemplary embodiment among various exemplary embodiments for effectively describing the characteristic of the present disclosure. Accordingly, the present disclosure is not limited to the drawings and descriptions below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present disclosure clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Figure 2:
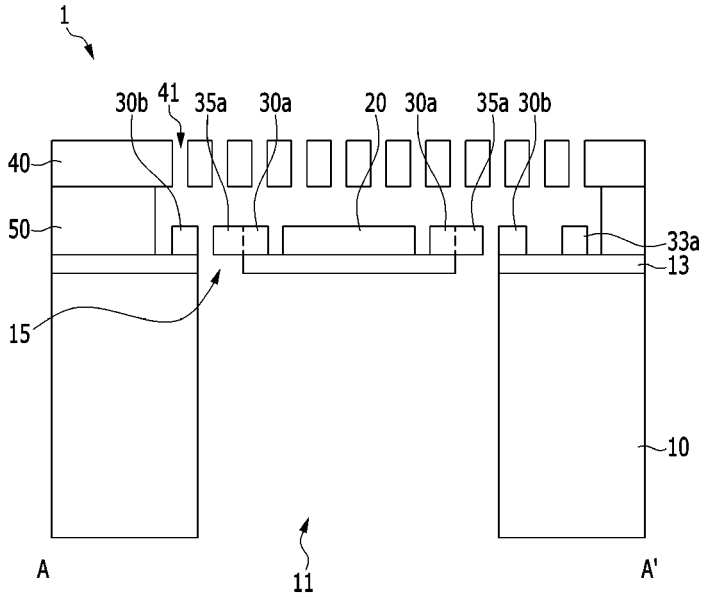
FIG. 2 is an exemplary cross-sectional view taken along line A-A' of FIG. 1 according to an exemplary embodiment of the present disclosure.

FIG. 1 is an exemplary top plan view of a microphone according to an exemplary embodiment of the present disclosure. FIG. 2 is an exemplary cross-sectional view taken along line A-A' of FIG. 1. A microphone 1 according to an exemplary embodiment of the present disclosure may have a wide acoustic pressure measurement range and may be configured to measure an acoustic signal regardless of a register of the input acoustic signal. Further, the microphone 1 according to the exemplary embodiment of the present disclosure may be manufactured based on a micro electro mechanical system (MEMS) technology.

A general structure of the microphone 1 will be briefly described with reference to FIG. 1. A diaphragm 20 and a displacement adjusting layer 30 may be formed on an upper surface of a substrate 10, in which a sound inlet 11 may be formed at a center thereof, through an insulating layer 13. A fixing layer 40 may be formed on the diaphragm 20 and the displacement adjusting layer 30 while being separated apart from the diaphragm 20 and the displacement adjusting layer 30 by a predetermined interval. In particular, for convenience of the description, an illustration of a aperture of the fixing layer 40 is omitted.

The microphone 1 may have a structure that adjusts a displacement, (e.g., hardness) of the diaphragm 20 by adjusting a voltage applied to the displacement adjusting layer 30 based on an acoustic pressure of the input sound. Herein, the displacement of the diaphragm 20 refers to a change in a distance between the diaphragm 20 and the fixing layer 40. In other words, the microphone 1 adjusts hardness of the diaphragm 20 based on the acoustic pressure of the input sound and adjusts a capacitance value between the diaphragm 20 and the fixing layer 40.

The microphone 1 will be described in more detail. The substrate 10 may be formed of a poly silicon, and the sound inlet 11 may be formed at the center of the substrate 10. Further, the insulating layer 13 may be bonded to the upper surface of the substrate 10. In particular, the insulating layer 13 may include a plurality of acoustic apertures, and may be formed of a silicon nitride (SiN).

Referring to FIG. 2, the diaphragm 20 may be disposed on an upper surface of the insulating layer 13. In particular, the diaphragm 20 may be formed of a conductive material and may vibrate in a state of being bonded to the insulating layer 13. The diaphragm 20 may be formed in a circular shape and an electrode pad 21 may extend at one side of the diaphragm 20 to electrically connect the diaphragm 20 with an external signal processing circuit 60. The present disclosure has been described based on when the diaphragm 20 is formed in a circular shape as an example, but is not limited thereto, and the shape of the diaphragm 20 may be changed and applied as necessary.

Further, the displacement adjusting layer 30 may be disposed on an upper surface of the insulating layer 13. In other words, the displacement adjusting layer 30 may be formed of a conductive material similar to the diaphragm 20. A portion of the displacement adjusting layer 30 that corresponds to a sound aperture 15 formed in the insulating layer 13 may be when bonded to the insulating layer 13.

The displacement adjusting layer 30 may be disposed to enclose an exterior surface of the diaphragm 20 in a single layer with the diaphragm 20 and may be formed of a first adjusting layer 30*a*, a second adjusting layer 30*b*, a first pad 33*a*, and a second pad 33*b*. Particularly, the first adjusting layer 30*a* may be formed adjacent to a circumference of an exterior surface of the diaphragm 20 and may include a plurality of first protruding steps 35*a* that extend to the exterior. Further, the second adjusting layer 30 may be formed along a circumference of the first adjusting layer 30*a* when spaced apart from the first adjusting layer 30*a* by a predetermined interval. The second adjusting layer 30*b* may include a plurality of second protruding steps 35*b* that extend inwardly at the positions that correspond to the first protruding steps 35*a* of the first adjusting layer 30*a*.

In other words, the first protruding step 35*a* and the second protruding step 35*b* may be alternately disposed and may form a shape (e.g., comb finger) to form a displacement adjusting unit 31. In particular, the displacement adjusting unit 31 may be formed by the first protruding step 35*a* and the second protruding step 35*b*. The plurality of displacement adjusting units 31 may be formed between the first adjusting layer 30*a* and the second adjusting layer 30*b* along a circumference.

The displacement adjusting layer 30 may be electrically connected with the external signal processing circuit 60 via the first pad 33*a* connected with the first adjusting layer 30*a* and the second pad 33*b* connected with the second adjusting layer 30*b*. Further, the fixing layer 40 may be disposed on the diaphragm 20 and the displacement adjusting layer 30. The fixing layer 40 may be fixed by a sacrificial layer 50 formed along a border of the upper surface of the insulating layer 13. In addition, the fixing layer 40 may be formed of a conductive material and may include a plurality of apertures 41.

The fixing layer 40 may be formed in a single layer or may be formed in double layers. In particular, the fixing layer 40 may be formed in a single layer including an electrode layer formed of poly silicon or may be formed in double layers including an electrode layer formed of poly silicon and an insulating layer formed of a silicon nitride disposed on an upper surface of the electrode layer. The fixing layer 40 may be electrically connected with the signal processing circuit 60 at one side thereof.

Figure 3:
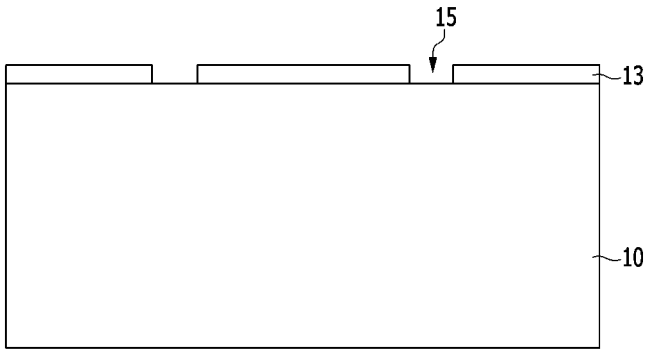
FIGS. 3 to 8 are exemplary process diagrams sequentially illustrating a manufacturing method of the microphone according to an exemplary embodiment of the present disclosure.

Hereinafter, a manufacturing method of a microphone according to an exemplary embodiment of the present disclosure will be described. FIGS. 3 to 8 are process diagrams sequentially illustrating a manufacturing method of the microphone according to an exemplary embodiment of the present disclosure. Referring to FIG. 3, a substrate 10 may be prepared, and then an insulating layer 13 may be formed on an upper surface of the substrate 10. In other words, a plurality of sound apertures 15 may be formed on the insulating layer 13.

Figure 4:
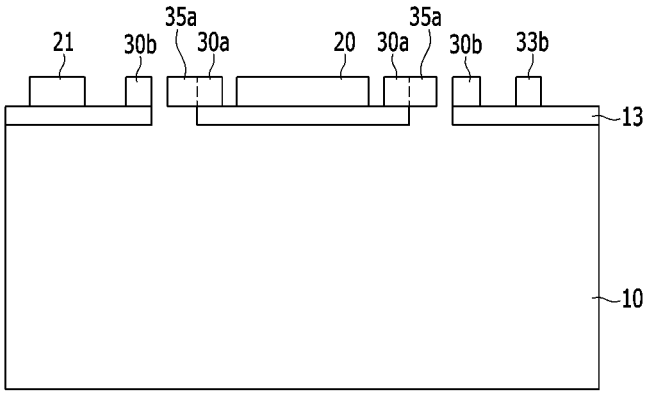

Referring to FIG. 4, a diaphragm 20 may be formed on an upper surface of the insulating layer 13. The diaphragm 20 may include an electrode pad 21 that extends at one side thereof and may be formed at a center of the upper portion of the insulating layer 13. A displacement adjusting layer 30 may be formed to enclose an exterior surface of the diaphragm 20 on the upper surface of the insulating layer 13. In particular, in the operation of forming the displacement adjusting layer 30, a first adjusting layer 30*a*, formed adjacent to a circumference of the exterior surface of the diaphragm 20 may be formed.

Further, a second adjusting layer 30*b*, formed along a circumference of an exterior surface of the first adjusting layer 30*a*, may be formed spaced apart from the first adjusting layer 30*a* by a predetermined interval. Additionally, a plurality of displacement adjusting units 31 formed between the first adjusting layer 30*a* and the second adjusting layer 30*b* may be positioned to correspond to the plurality of sound apertures 15 of the insulating layer 13, respectively. In other words, a first protruding step 35*a* of the first adjusting layer 30*a* and a second protruding step 35*b* of the second adjusting layer 30*b* may be alternately disposed to form the displacement adjusting unit 31.

Figure 5:
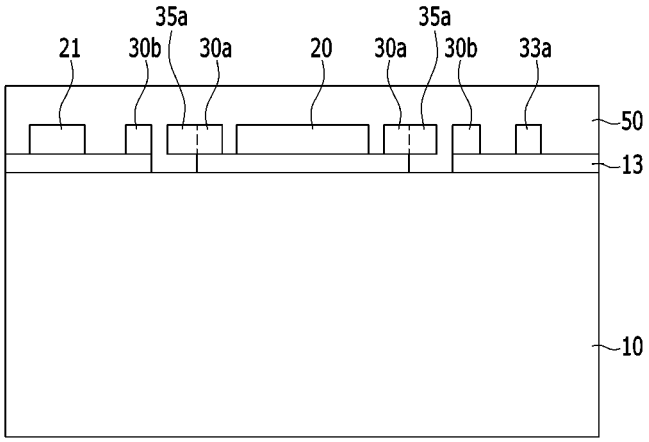

Referring to FIG. 5, a sacrificial layer 50 may be formed on the upper surface of the insulating layer 13. In other words, the sacrificial layer 50 may be formed to cover the diaphragm 20 and the displacement adjusting layer 30 and may be formed of silica ($SiO_2$).

Figure 6:
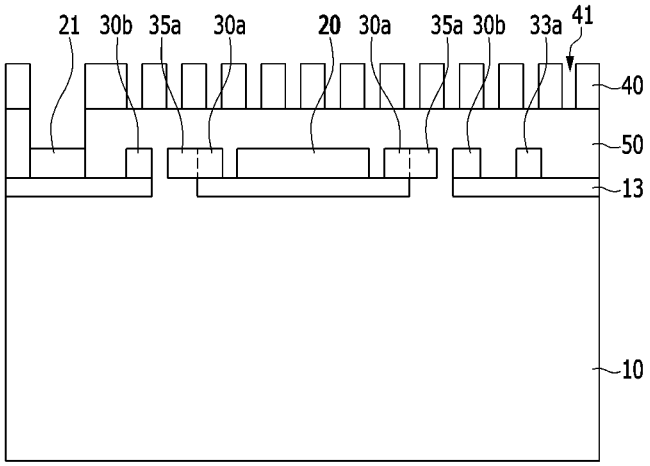

Referring to FIG. 6, a fixing layer 40 may be formed on an upper surface of the sacrificial layer 50. For example, the fixing layer 40 may be formed in a single layer and may alternatively be formed in double layers. In other words, the fixing layer 40 may be formed in a single layer including an electrode layer formed of poly silicon and may be formed in double layers including an electrode layer formed of poly silicon and an insulating layer formed of a silicon nitride on an upper surface of the electrode layer. Subsequently, a plurality of apertures 41 may be formed in the fixing layer 40. Simultaneously, the electrode pad 21 may be exposed by etching the sacrificial layer 50 that corresponds to the electrode pad 21 of the diaphragm 20.

Figure 7:
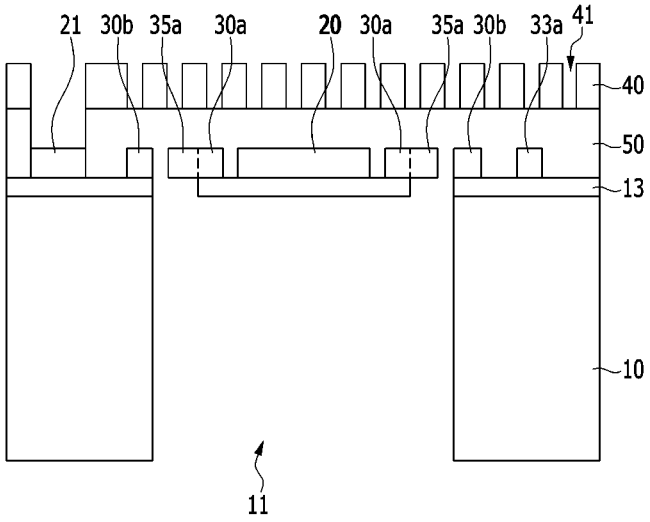
Figure 8:
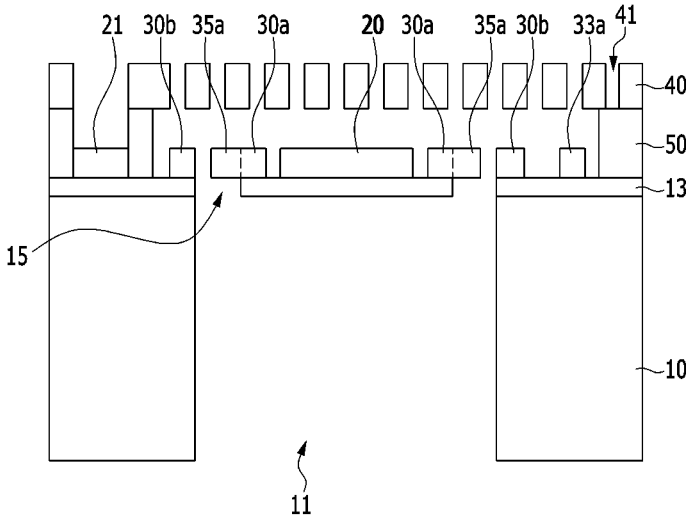

Referring to FIG. 7, a sound inlet 11, which passes through the substrate 10, may be formed by etching a rear surface of the substrate 10. The sound inlet 11 may be formed be at about a center of the substrate 10. Referring to FIG. 8, a portion of the sacrificial layer 50 may be removed through the sound inlet 11 and the sound apertures 15. In other words, the remaining portions, except for a border of the sacrificial layer 50 may be removed.

Figure 9:
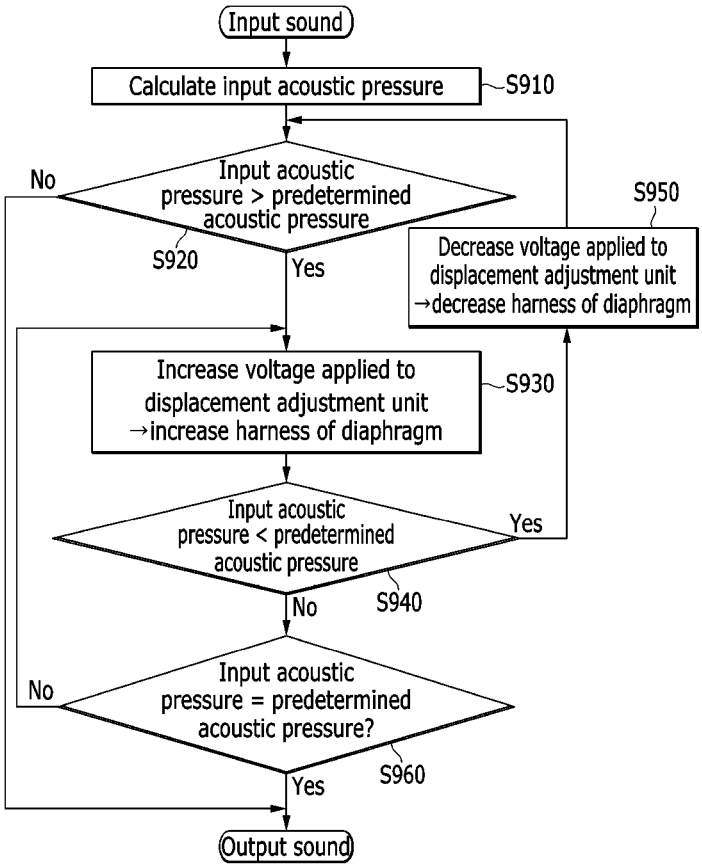
FIG. 9 is an exemplary flowchart illustrating a control method of the microphone according to an exemplary embodiment of the present disclosure.

Hereinafter, a control method of the microphone according to an exemplary embodiment of the present disclosure will be described. FIG. 9 is an exemplary flowchart illustrating a control method of the microphone according to an exemplary embodiment of the present disclosure. Referring to FIG. 9, the microphone 1 may be configured to receive a sound from the exterior.

The signal processing circuit 60 may be configured to measure a capacitance value, which may be adjusted by a sound input into the microphone 1, between the diaphragm 20 and the fixing layer 40 and may be configured to calculate an input acoustic pressure (S910). The signal processing circuit 60 may be configured to compare the input acoustic pressure and a predetermined acoustic pressure, and determine whether the input acoustic pressure exceeds the predetermined acoustic pressure (S920). In particular, when the input acoustic pressure is greater than the predetermined acoustic pressure, the signal processing circuit 60 may be configured to apply a voltage to the displacement adjusting unit 31 and to improve hardness of the diaphragm 20 (S930). In other words, according to the application of the voltage to the displacement adjusting unit 31, hardness of the diaphragm 20 may be improved by gravitation generated between the first protruding step 35*a* and the second protruding step 35*b* of the displacement adjusting unit 31.

The displacement adjusting unit 31 may be vibrated relatively less even though a sound having a high input acoustic pressure may be input. Accordingly the microphone 1 may be configured to measure the sound by decreasing sensitivity of the sound, and the hardness of the displacement adjusting unit 31 may be maintained until a displacement of a newly input voltage is generated. Further, when the input acoustic pressure is equal to or less than the predetermined acoustic pressure, the signal processing circuit 60 may be configured to output the sound and terminate the operation.

When a new sound is input when the hardness of the displacement adjusting unit 31 is improved, the signal processing circuit 60 may be configured to compare an input acoustic pressure of the newly input sound with the predetermined acoustic pressure and determine whether the input acoustic pressure is less than the predetermined acoustic pressure (S940). In particular, when the input acoustic pressure is less than the predetermined acoustic pressure, the signal processing circuit 60 may be configured to decrease a voltage applied to the displacement adjusting unit 31 and decrease the improved hardness of the diaphragm 20 (S950). Herein, the signal processing circuit 60 may be configured to decrease the hardness of the displacement adjusting unit 31 until the hardness of the displacement adjusting unit 31 is in an initial state.

Additionally, when the input acoustic pressure is equal to or greater than the predetermined acoustic pressure, the signal processing circuit 60 may be configured to determine whether the input acoustic pressure is equal to the predetermined acoustic pressure again (S960). In particular, when the input acoustic pressure is equal to the predetermined acoustic pressure, the signal processing circuit 60 may be configured to output the sound and terminate the operation.

Further, when the input acoustic pressure is greater than the predetermined acoustic pressure, the signal processing circuit 60 may be configured to improve hardness of the displacement adjusting unit 31 by increasing a voltage applied to the displacement adjusting unit 31. The signal processing circuit 60 may be configured to compare the input acoustic pressure with the predetermined acoustic pressure and increase an acoustic pressure measurement range by continuously repeating the aforementioned process. Accordingly, the microphone 1 according to the exemplary embodiment of the present disclosure may improve an acoustic pressure measurement range by adjusting a displacement of the diaphragm 20 according to an acoustic pressure of an acoustic signal.

In particular, even though an acoustic signal having a high acoustic pressure or an acoustic signal having a low acoustic pressure is input, the microphone 1 may improve an acoustic pressure measurement range by adjusting a size of a voltage applied to the displacement adjusting layer 30 and adjusting hardness of the diaphragm 20. Accordingly, the microphone 1 may be configured to detect a wide acoustic pressure range and output an acoustic signal based on the detected acoustic pressure range.

While this disclosure has been described in connection with what is presently considered to be example embodiments, it is to be understood that the disclosure is not limited to the disclosed exemplary embodiments, but, on the contrary, is intended to cover various modifications and equivalent arrangements included within the spirit and scope of the appended claims.

DESCRIPTION OF SYMBOLS

1 . . . Microphone
10 . . . Substrate
11 . . . Sound aperture
20 . . . Diaphragm
21 . . . Sound inlet
30 . . . Displacement adjusting layer
30*a* . . . First adjusting layer
30*b* . . . Second adjusting layer
31 . . . Displacement adjusting unit
33*a* . . . First pad
33*b* . . . Second pad
35*a* . . . First protruding step
35*b* . . . Second protruding step
40 . . . Fixing layer
41 . . . Through-aperture
50 . . . Sacrificial layer
60 . . . Signal processing circuit

What is claimed is:

1. A microphone, comprising:

an insulating layer bonded to a surface of a substrate, in which a sound inlet is formed, and includes a plurality of sound apertures;

a diaphragm formed at a position that corresponds to the sound inlet of the substrate on an upper surface of the insulating layer;

a displacement adjusting layer disposed in a circumference of the diaphragm on the upper surface of the insulating layer and configured to adjust hardness of the diaphragm based on an input sound; and a fixing layer disposed on the diaphragm and the displacement adjusting layer while spaced apart from the diaphragm and the displacement adjusting layer, wherein the displacement adjusting layer includes:

a first adjusting layer formed adjacent to a circumference of the diaphragm;

a second adjusting layer formed along a circumference of the first adjusting layer and spaced apart from the first adjusting layer; and a first pad coupled to the first adjusting layer and a second pad coupled to the second adjusting layer, wherein a plurality of displacement adjusting are formed between the first adjusting layer and the second adjusting layer, and wherein in the displacement adjusting unit, a plurality of first protruding steps that extend from the first adjusting layer to an external side are alternately disposed with a plurality of second protruding steps that extend from the second adjusting layer to an internal side.

2. The microphone of claim 1, wherein the displacement adjusting units are formed at portions that correspond to the sound apertures of the insulating layer.

3. The microphone of claim 1, wherein the fixing layer is coupled to a sacrificial layer formed along a border of the upper surface of the insulating layer.

4. The microphone of claim 1, wherein the fixing layer includes a plurality of apertures.

5. A method of manufacturing a microphone, comprising:

forming an insulating layer on an upper surface of a substrate;

forming a plurality of sound apertures in the insulating layer;

forming a diaphragm and a displacement adjusting layer on an upper surface of the insulating layer;

forming a sacrificial layer to cover the diaphragm and the displacement adjusting layer on the upper surface of the insulating layer;

forming a fixing layer on an upper surface of the sacrificial layer;

forming a plurality of apertures by etching the fixing layer;

exposing an electrode pad of the diaphragm by etching a portion of the sacrificial layer;

forming a sound inlet by etching a center portion of the substrate; and removing a portion of the sacrificial layer, wherein the forming of the displacement adjusting layer includes forming a first adjusting layer adjacent to a circumference of the diaphragm; and forming a second adjusting layer along a circumference of the first adjusting layer spaced apart from the first adjusting layer, wherein the plurality of displacement adjusting units are formed between the first adjusting layer and the second adjusting layer, and wherein a plurality of first protruding steps that extend from the first adjusting layer to an external side are alternately disposed with a plurality of second protruding steps that extend from the second adjusting layer to an internal side, to form the plurality of displacement adjusting units.

6. The method of claim 5, wherein the forming of the diaphragm further includes forming an electrode pad extended from a side of the diaphragm and connecting the electrode pad with an external signal processing circuit.

7. The method of claim 5, wherein the forming of the displacement adjusting layer further includes connecting the displacement adjusting layer to an external signal processing circuit through a first pad connected with the first adjusting layer and a second pad connected with the second adjusting layer.

8. A method of controlling a microphone, which includes a fixing layer, a diaphragm, and a plurality of displacement adjusting units formed between a displacement adjusting layer disposed in a circumference of the diaphragm, the method comprising:

comparing, by a processor, an input acoustic pressure measured based on a capacitance value, which is varied by a sound, between the diaphragm and the fixing layer with a predetermined acoustic pressure; and increasing, by the processor, a voltage applied to the displacement adjusting unit when the input acoustic pressure is greater than the predetermined acoustic pressure as a result of the comparison, wherein hardness of the diaphragm is adjusted based on a size of the voltage applied to the displacement adjusting unit.

* * * * *